US005967396A

United States Patent [19]

Chuang

[11] Patent Number: 5,967,396

[45] Date of Patent: Oct. 19, 1999

[54] STAPLES ADJUSTING DEVICE FOR A MAGAZINE OF A POWER STAPLER

[75] Inventor: Hung-Ming Chuang, Taichung, Taiwan

[73] Assignee: Mewco Pneumatic Corp., Taichung, Taiwan

[21] Appl. No.: 09/192,369

[22] Filed: Nov. 16, 1998

[51] Int. Cl.[6] ..... B25C 1/04

[52] U.S. Cl. ..... 227/109; 227/119; 227/120

[58] Field of Search ..... 227/119, 109, 227/120, 135, 136

[56] References Cited

U.S. PATENT DOCUMENTS

| | | | |
|---|---|---|---|
| 4,728,021 | 3/1988 | Kennedy | 227/109 |
| 5,588,577 | 12/1996 | Chen | 227/120 |
| 5,632,431 | 5/1997 | Lin | 227/109 |
| 5,743,453 | 4/1998 | Chuang | 227/120 |

*Primary Examiner*—Scott A. Smith
*Attorney, Agent, or Firm*—Rosenberg, Klein & Lee

[57] ABSTRACT

A staples adjusting device includes two boards received in the magazine and one of the two boards has a recess defined in the inside thereof, and a concavity is defined in the bottom of the recess. An adjusting plate is movably received between the two boards and has two inclined slots defined in two ends thereof, each of the slots has a boss of an actuating member extending therethrough. A protrusion extends from the actuating member and a rod extends through the protrusion. The rod has a stop extending radially outward therefrom and two springs are mounted to the rod and biased between the stop and the protrusion, and between the inside of the concavity and the protrusion so that when pushing the rod to compress the springs, the adjusting plate is moved to push the staples contacting against the inside of the magazine by moving the two bosses in the two inclined slots so that there will be no gap defined between the staples and the inside of the magazine.

3 Claims, 9 Drawing Sheets

STAPLES ADJUSTING DEVICE FOR A MAGAZINE OF A POWER STAPLER

FIELD OF THE INVENTION

The present invention relates to a staplers adjusting device, and more particularly, to a staplers adjusting device for a magazine of a power staplers, wherein the device comprises an adjusting plate with two inclined slots which can be pushed by two protrusions extending through the slots so as to push the staplers against the inside of the magazine.

BACKGROUND OF THE INVENTION

FIG. 1 show a conventional magazine 10 for a power stapler, staples 12 are received in the magazine 10 and pushed by a block 11 which is biased upwardly to force the top-most staple contacting against the stopper board 13. The top-most staple will be ejected by an ejector (not shown) of the power stapler into a desired object. Because the width in the magazine 10 is fixed so that there will be a gap "d" defined between the front tip of the staples 12 and the inside of the magazine 10, and the power to eject the staples is so powerful that the following staples 12 could be influenced and inclined toward the gap "d" as shown in FIG. 2. This is happened frequently and it takes time to preclude such "jam" situation.

The present invention intends to provide a staples adjusting device and includes a movable adjusting plate which push the staples to contact against the inside of the magazine so as to eliminate the gap defined between the staples and the inside of the magazine.

The present invention is automatically adjust the staples which is shorter than the width of the staple magazine so that the inherent shortcomings found in the conventional magazine can be well overcome.

SUMMARY OF THE INVENTION

In accordance with one aspect of the present invention, there is provided a staples adjusting device comprising two boards received in the magazine, at least one of the two boards having a recess defined in the inside thereof. A concavity is defined in the bottom of the recess. An adjusting plate is movably received between the two boards and has two inclined slots defined in two ends thereof.

An actuating member has two bosses extending laterally from two ends thereof and the two bosses respectively extend through the two inclined slots. A protrusion extends from the actuating member and has a hole defined therethrough. A rod has a stop extending radially outward therefrom and extends through the hole of the protrusion. A first spring is mounted to the rod and biased between the stop and the protrusion, a second spring mounted to the rod and biased between the inside of the concavity and the protrusion.

It is an object of the present invention to provide a staples adjusting device which pushes the staples to contact against the inside of the magazine by pushing the rod of the device upwardly.

Further objects, advantages, and features of the present invention will become apparent from the following detailed description with appropriate reference to the accompanying drawings.

DETAILED DESCRIPTION OF THE PREFERRED EMBODIMENTS

Figure 2:
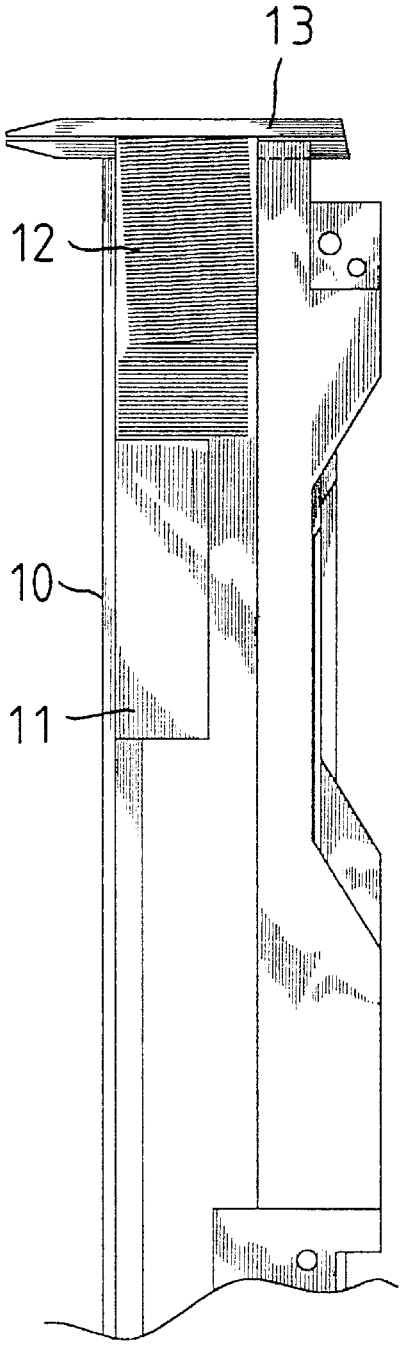
FIG. 2 PRIOR ART
FIG. 2 is a side elevational view, partly in section, of the conventional staple magazine wherein the staples are inclined toward the inside of the magazine.
Figure 1:
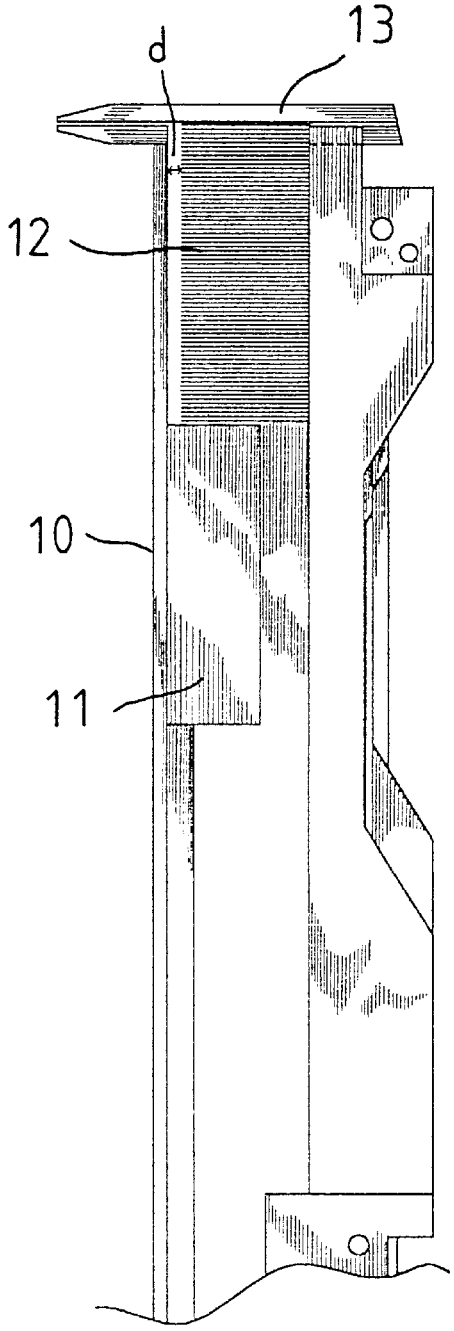
FIG. 1 PRIOR ART
FIG. 1 is a side elevational view, partly in section, of the conventional staple magazine wherein a gap is defined between the staples and the inside of the magazine.
Figure 3:
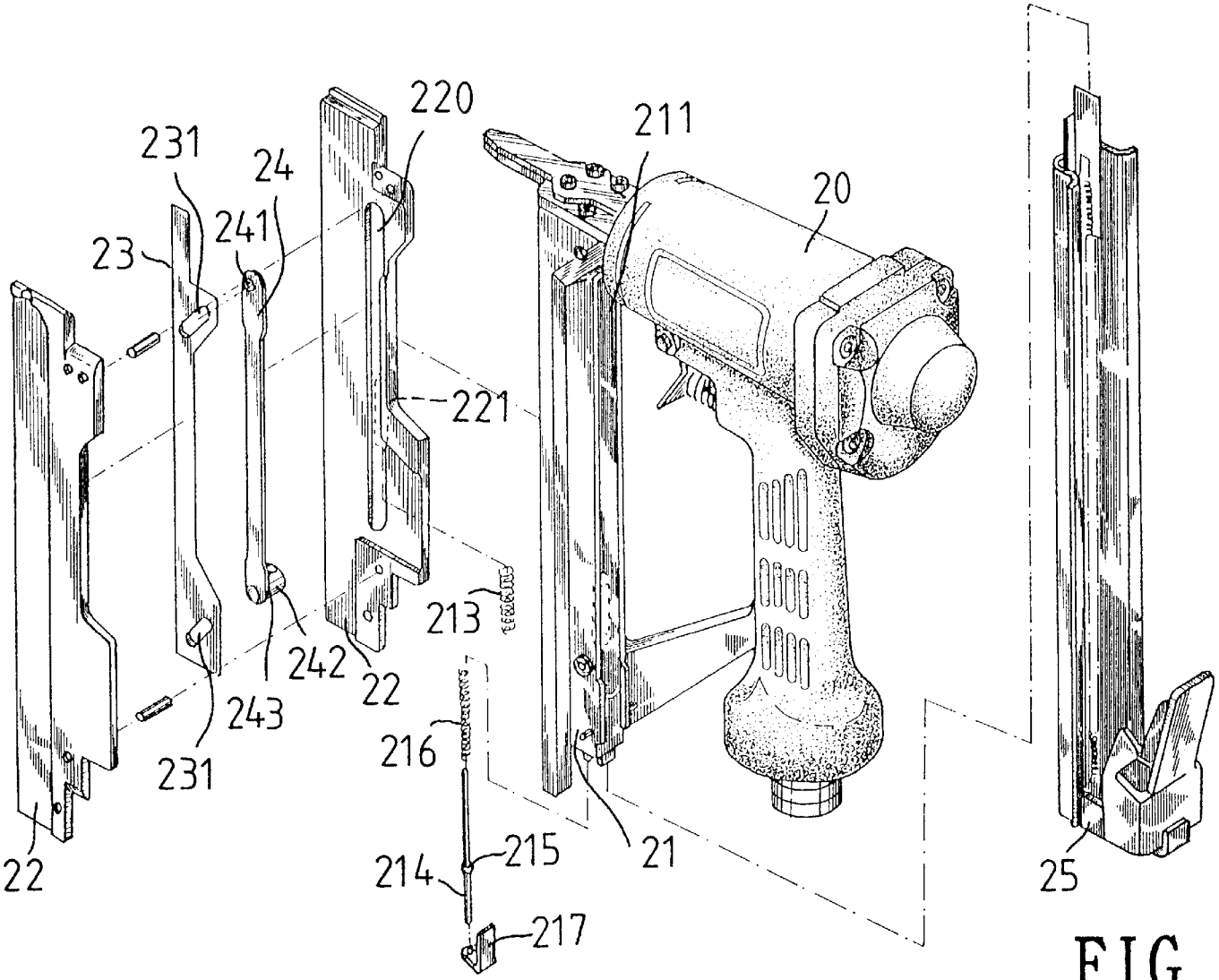
FIG. 3 is an exploded view of the staples adjusting device in accordance with the present invention and the power stapler.
Figure 4:
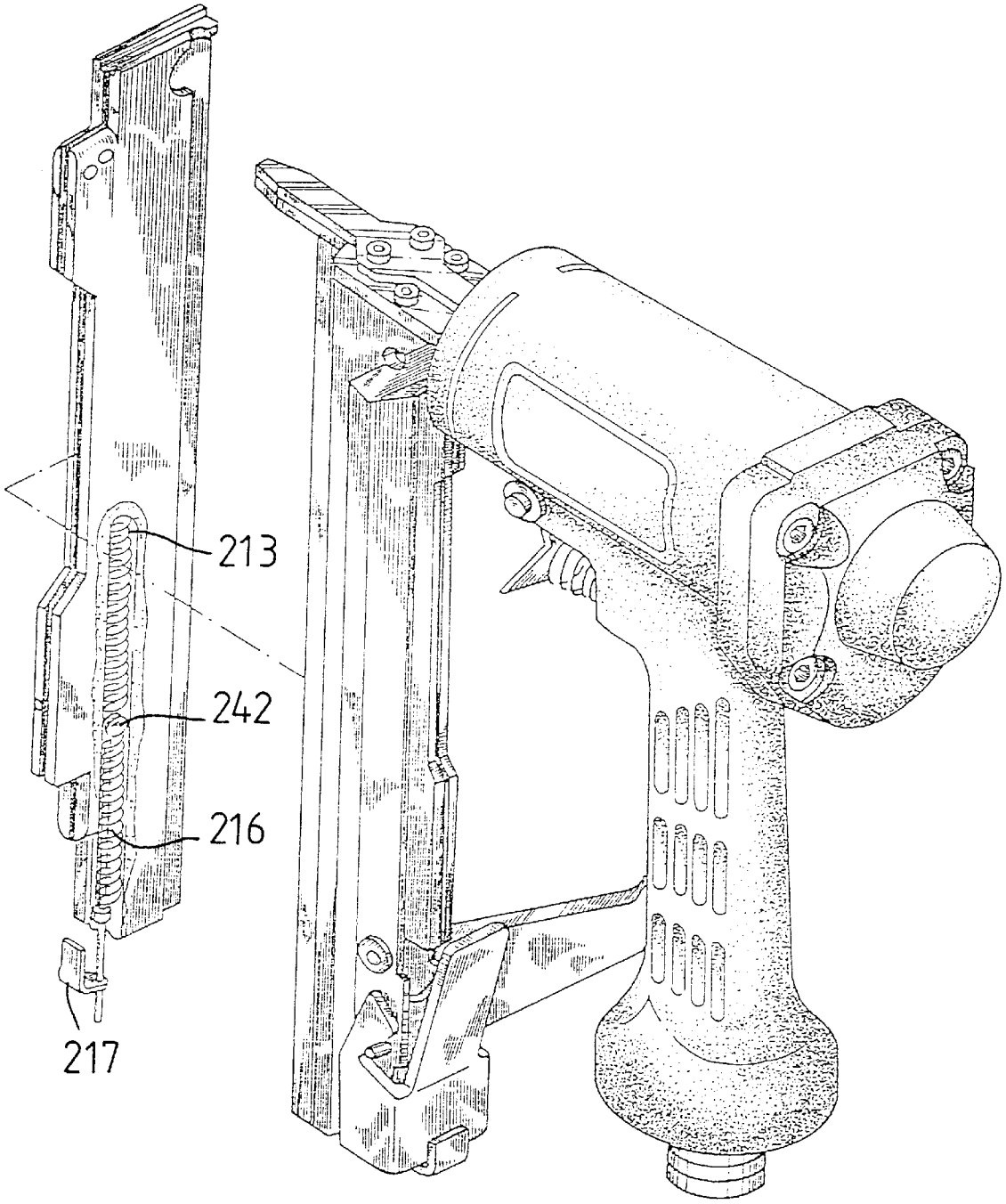
FIG. 4 is an exploded view of the assembled staples adjusting device in accordance with the present invention and the power stapler.
Figure 5:
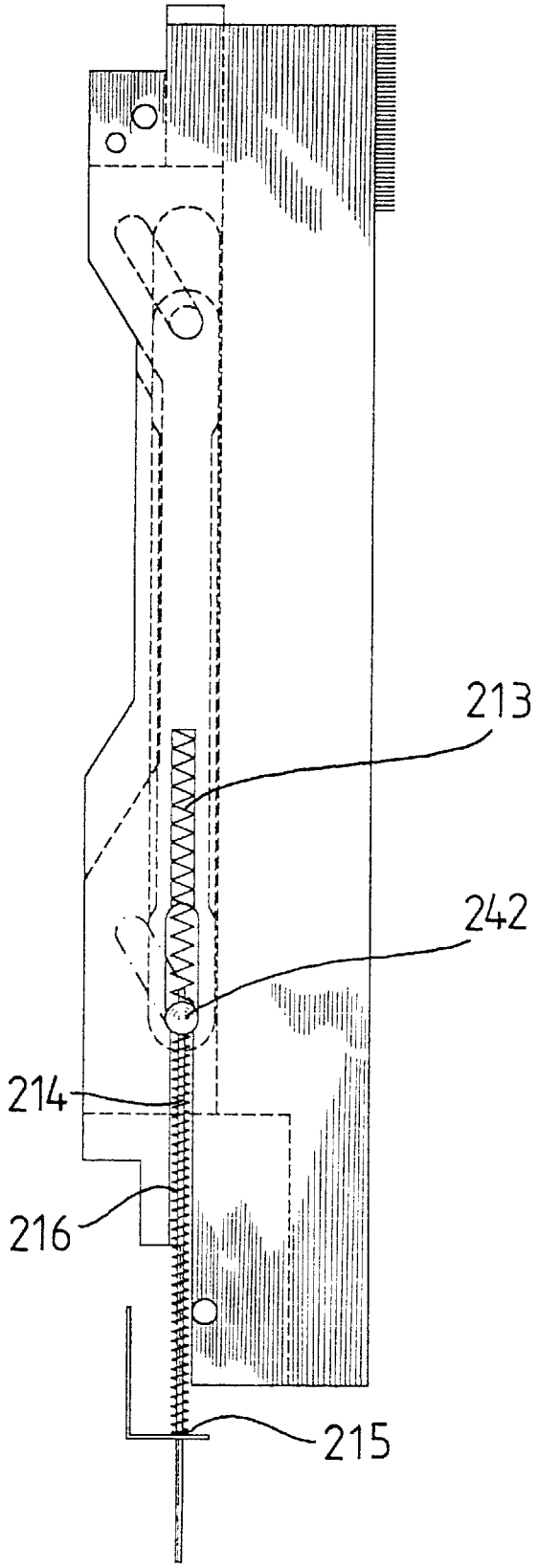
FIG. 5 is an illustrative view to show the arrangement of the adjusting plate, the two bosses extending through the two slots and the rod.
Figure 7:
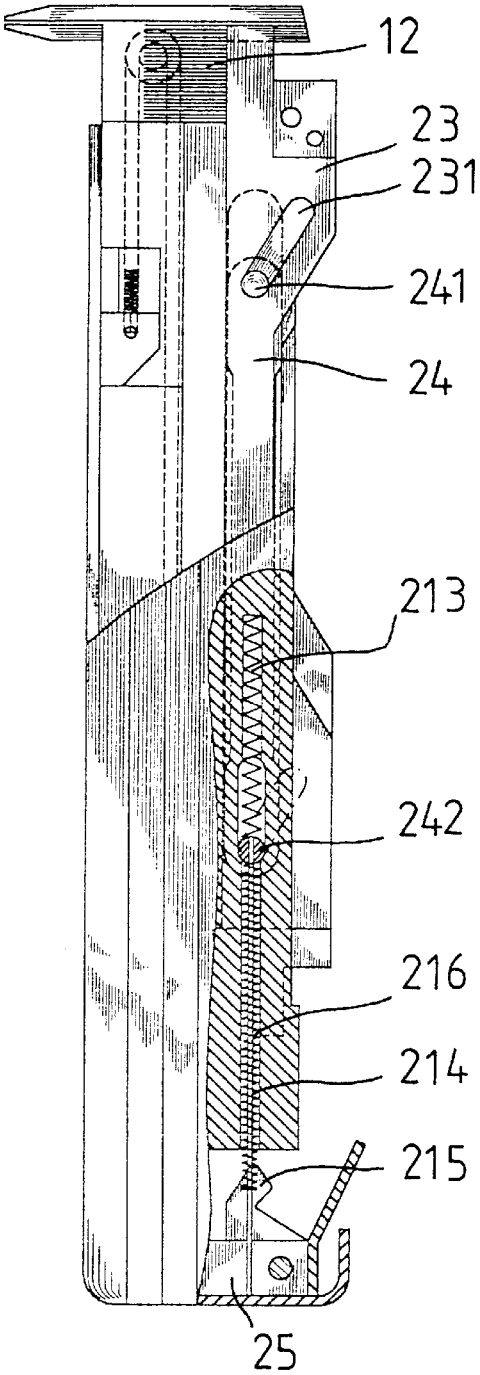
FIG. 7 is a side elevational view, partly in section, of the staple magazine with the rod of the staples adjusting device of the present invention is about to be inserted into the magazine.
Figure 6:
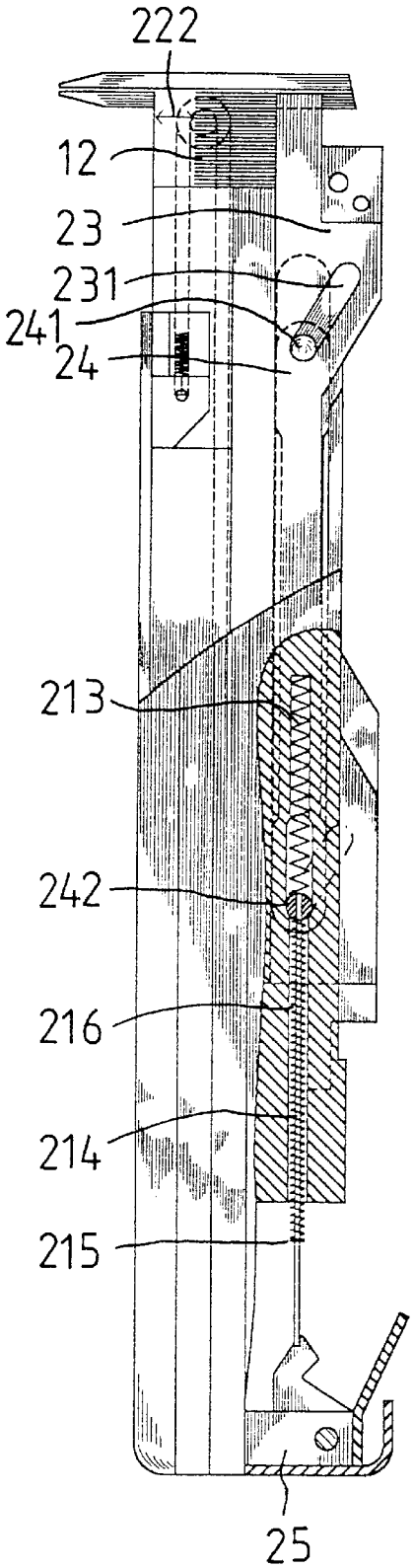
FIG. 6 is a side elevational view, partly in section, of the staple magazine with the staples adjusting device of the present invention is about to be operated.

Referring to FIGS. 3 to 5, the staples adjusting device in accordance with the present invention comprises two boards 22 which are received in the space 211 defined in the magazine 21 to which a cover board 25 is removably attached. At least one of the two boards 22 has a recess 220 defined in the inside thereof and a concavity 21 is defined in the bottom of the recess 220. An adjusting plate 23 is movably received between the two boards 22 and has two inclined slots 231 defined in the two ends thereof.

An actuating member 24 has two bosses 241 extending laterally from two ends thereof and the two bosses 241 respectively extend through the two inclined slots 231. A protrusion 242 extends from the actuating member 24 and is located at the opposite side corresponding to the side from which the two bosses 241 extend. The protrusion 242 has a hole 243 defined therethrough.

A rod 214 has a stop 215 extending radially outward therefrom and extends through the hole 243 of the protrusion 242. A first spring 216 and a second spring 213 are respectively mounted to the rod 214, wherein the first spring 213 is biased between the stop 215 and the protrusion 242, and the second spring 213 is mounted to said rod 214 and biased between the inside of the concavity 221 and the protrusion 242. The first spring 216 and the second spring 213 have different elastic characters. An end member 217 is connected to the lower end of the rod 214.

Figure 9:
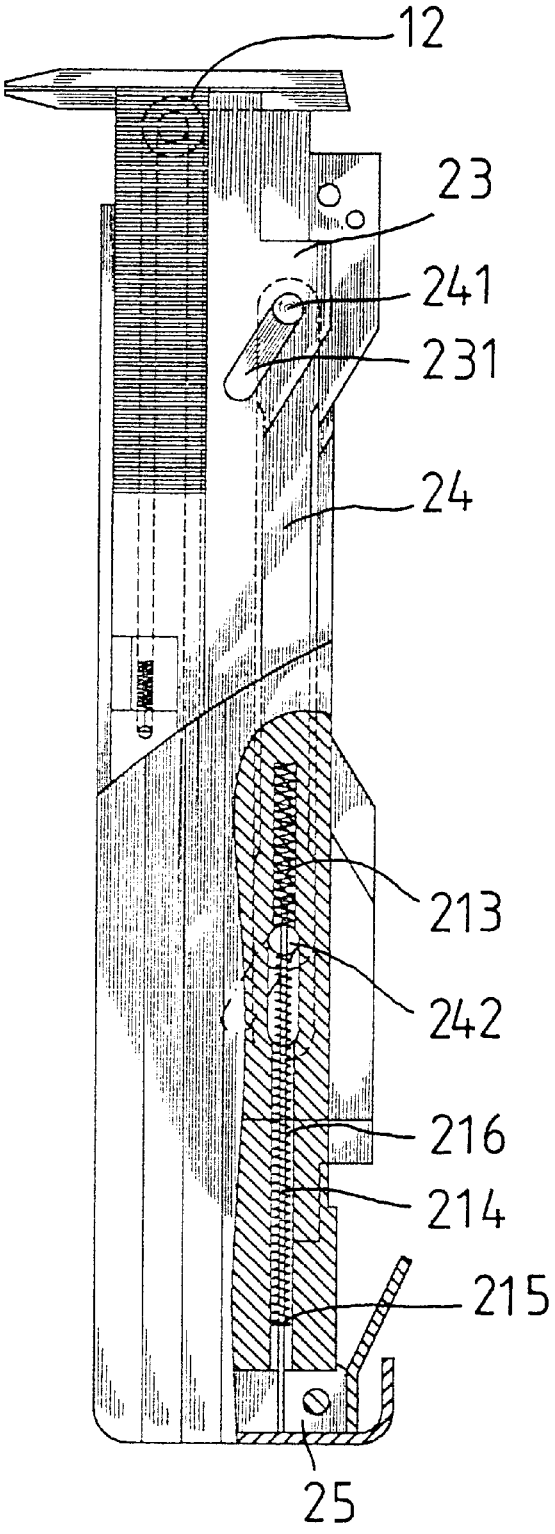
FIG. 9 is a side elevational view, partly in section, of the staple magazine with the adjusting plate is completely moved to push the staplers to contact against the inside of the magazine.
Figure 8:
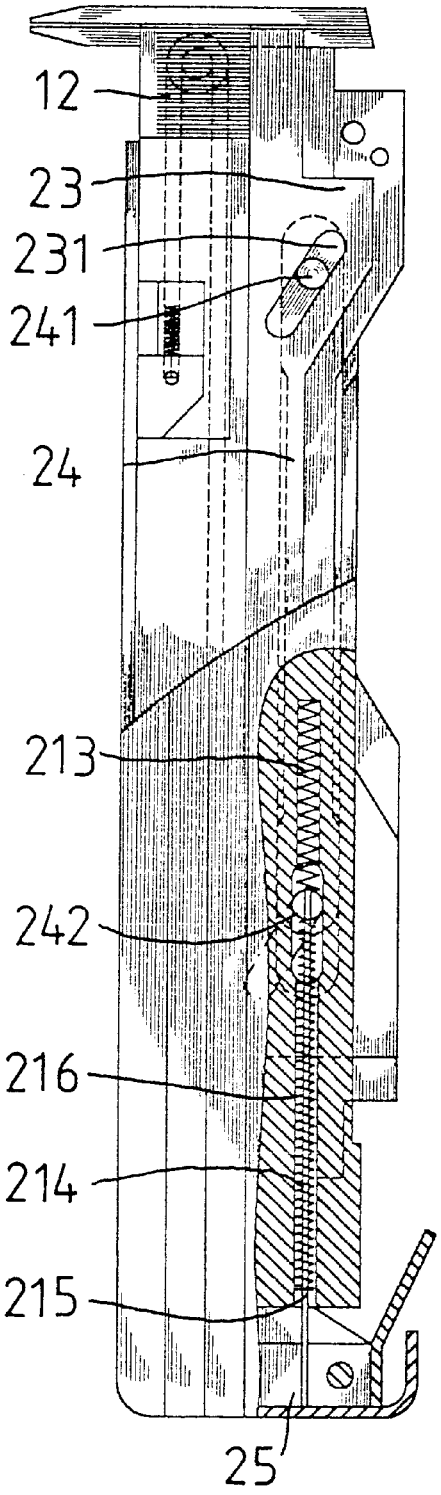
FIG. 8 is a side elevational view, partly in section, of the staple magazine with the adjusting plate is moved by pushing the rod.
Figure 10:
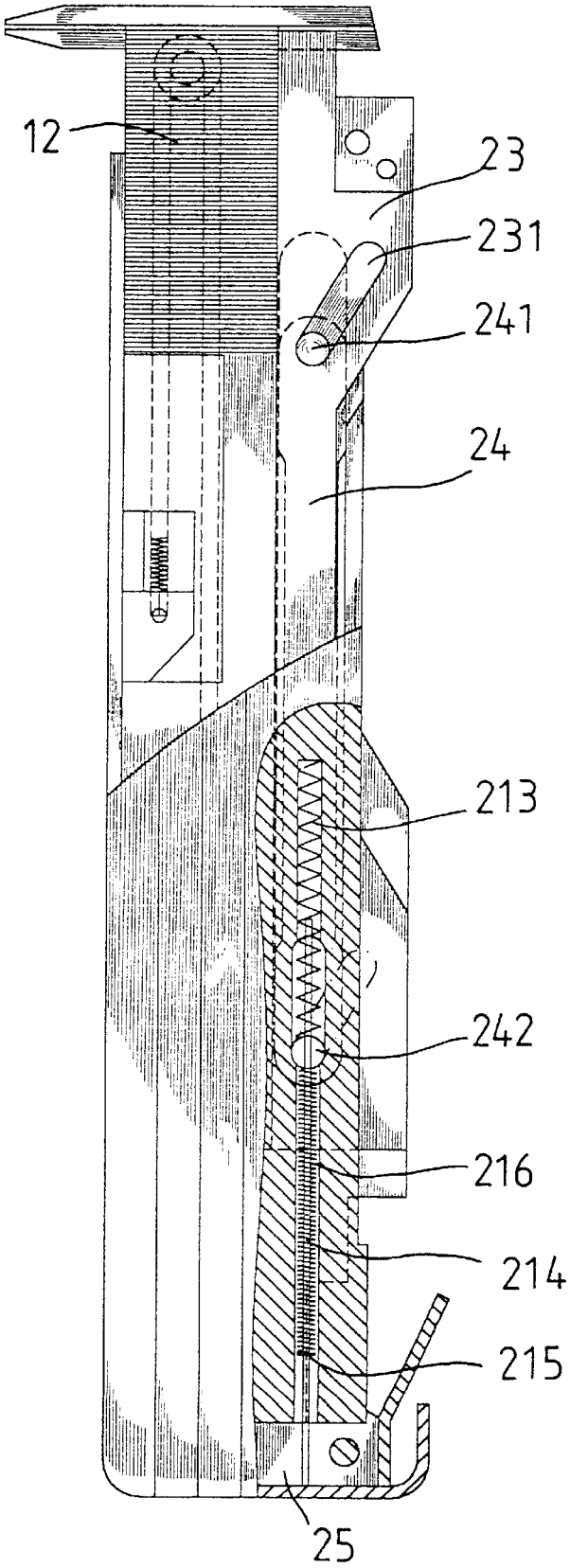
FIG. 10 is a side elevational view, partly in section, of the staple magazine wherein the full size staples are received in the magazine.

Referring to FIGS. 6 to 9, when the combination of the two boards 22, the adjusting plate 23 and the actuating member 24 is connected to the cover board 25 and are together pushed toward the power stapler 20, the rod 214 is moved upwardly to compress the first spring 216 and the second spring 213 so that the adjusting plate 23 is moved toward the inside of the magazine 21 by moving the two bosses 241 in the two inclined slots 231. Therefore, the gap 222 defined between the staples 12 and the inside of the magazine 21 is eliminated by the movement of the staples 12 as shown in FIG. 9. In other words, by the movement of the adjusting plate 23, any staples 12 having the length less than the width of the magazine 21 can be easily adjusted in alignment with each other so as to prevent from being jammed. When the staples 12 have the correct size which is the same as the width between the inside of the magazine 21 and the adjusting plate 23, when pushing the rod 214 upwardly, only the first spring 216 is compressed which has a less elastic force and the adjusting plate 23 is urged by the staples 12 to let the two bosses 241 stay at the lower end of the inclined slots 231.

Figure 11:
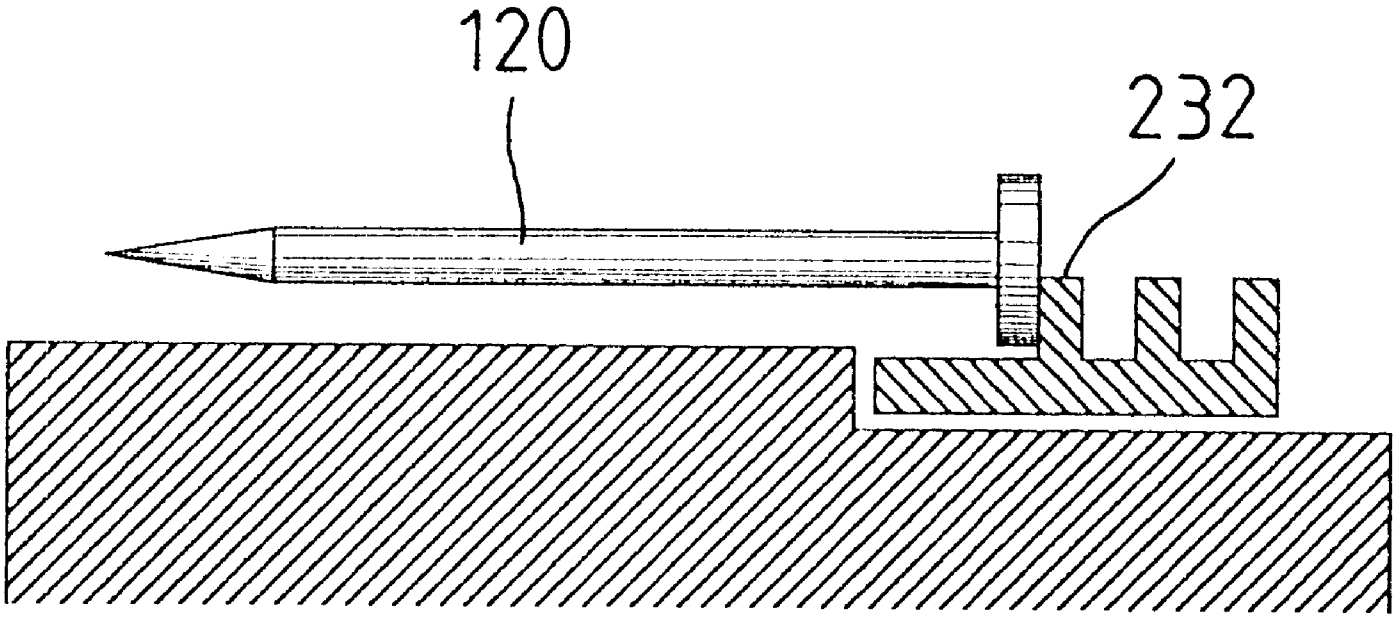
FIG. 11 is an illustrative view to show a pushing member is connected to the adjusting plate to push the head portion of the nail.
Figure 12:
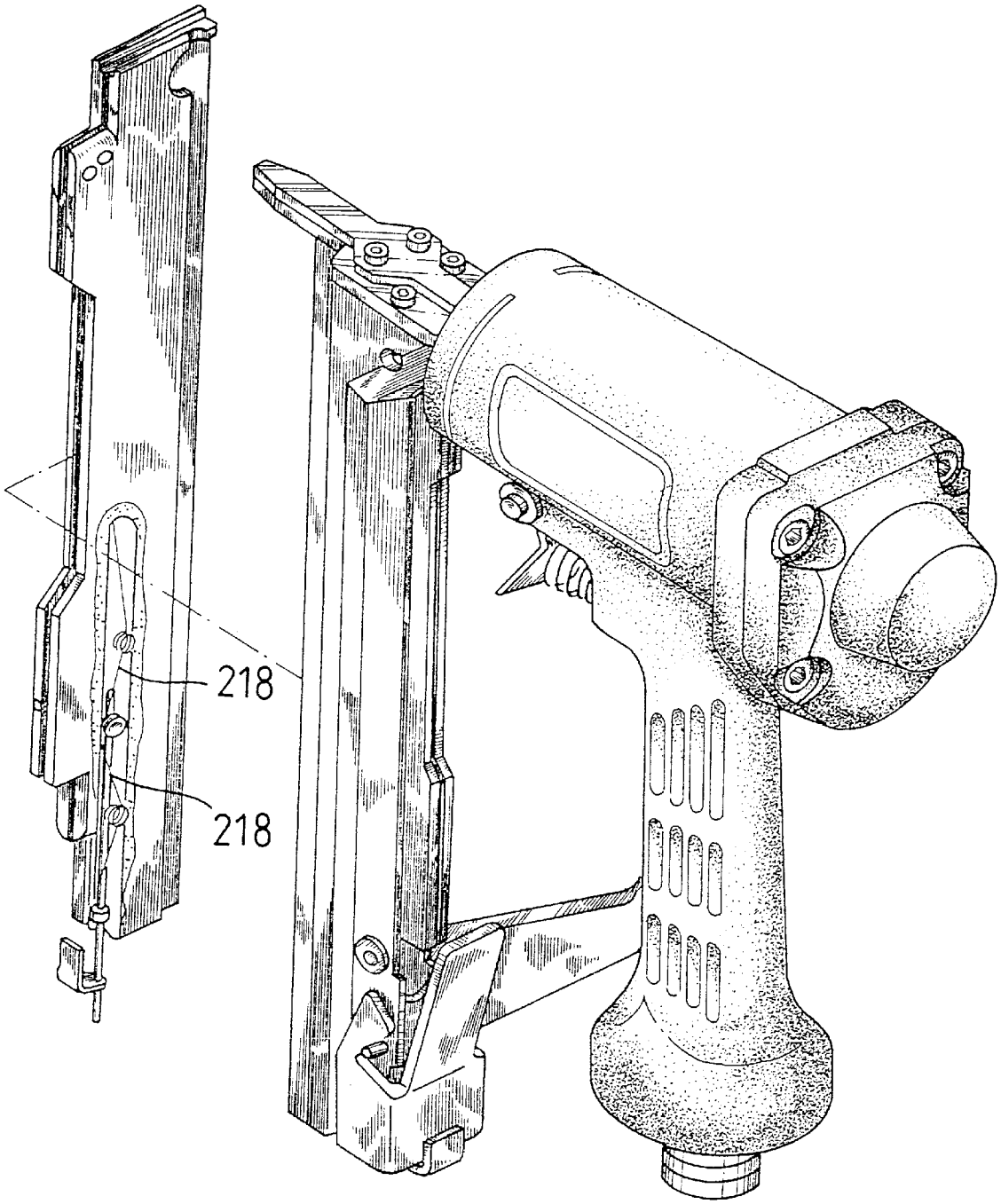
FIG. 12 is an exploded view of another embodiment of the staples adjusting device in accordance with the present invention and the power stapler.

Referring to FIG. 11, when using nails 120 in the magazine 21, a pushing member 232 is connected to the top of said adjusting plate 23 so as to contact the head portion of the nail 120. FIG. 12 shows another embodiment of the adjusting device of the present invention, wherein the first spring and the second spring are replaced by two torsion springs 218 which can perform the same function.

The invention is not limited to the above embodiment but various modification thereof may be made. It will be understood by those skilled in the art that various changes in form and detail may made without departing from the scope and spirit of the present invention.

What is claimed is:

1. A staples adjusting device comprising:

two boards adapted to be received in the magazine, at least one of said two boards having a recess defined in the inside thereof, a concavity defined in the bottom of said recess;

an adjusting plate movably received between said two boards and having two inclined slots defined in the two ends thereof;

an actuating member having two bosses extending laterally from two ends thereof and said two bosses respectively extending through said two inclined slots, a protrusion extending from said actuating member and having a hole defined therethrough, and a rod having a stop extending radially outward therefrom and extending through said hole of said protrusion, a first spring mounted to said rod and biased between said stop and said protrusion, a second spring mounted to said rod and biased between the inside of said concavity and said protrusion so that when pushing said rod, said adjusting plate is adapted to be moved toward the inside of the magazine by moving said two bosses in said two inclined slots.

2. The device as claimed in claim 1 further comprising an end member connected to the lower end of said rod.

3. The device as claimed in claim 1 further comprising a pushing member connected to the top of said adjusting plate.

* * * * *